US009188913B2

(12) United States Patent
Matsuyama et al.

(10) Patent No.: US 9,188,913 B2
(45) Date of Patent: Nov. 17, 2015

(54) FIXING DEVICE AND IMAGE FORMING APPARATUS

(71) Applicant: KYOCERA Document Solutions Inc., Osaka (JP)

(72) Inventors: Ryo Matsuyama, Osaka (JP); Shinji Nemoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/254,912

(22) Filed: Apr. 17, 2014

(65) Prior Publication Data

US 2014/0314455 A1 Oct. 23, 2014

(30) Foreign Application Priority Data

Apr. 22, 2013 (JP) ..... 2013-089072

(51) Int. Cl.
*G03G 15/20* (2006.01)

(52) U.S. Cl.
CPC ..... *G03G 15/2028* (2013.01)

(58) Field of Classification Search
CPC ..... G03G 15/2053; G03G 15/2085; G03G 15/2025; G03G 15/2028; G03G 15/2046
USPC ..... 399/33, 323
See application file for complete search history.

(56) References Cited

U.S. PATENT DOCUMENTS

2010/0303523 A1* 12/2010 Yamada ..... 399/323
2011/0026986 A1* 2/2011 Yamanaka et al. ..... 399/323
2011/0222876 A1* 9/2011 Yuasa et al. ..... 399/33

FOREIGN PATENT DOCUMENTS

JP 2006-030945 A 2/2006
JP 2006-317492 A 11/2006

* cited by examiner

*Primary Examiner* — Walter L Lindsay, Jr.
*Assistant Examiner* — Jessica L Eley
(74) *Attorney, Agent, or Firm* — Studebaker & Brackett PC

(57) ABSTRACT

A fixing device includes a heating source, a pressing member, a heating member, a nip pressure switching mechanism, a separating member and a restricting piece. The pressing member comes in pressure-contact with the heating member and forms a fixing nip. The nip pressure switching mechanism moves the pressing member between a first position and a second position. The separating member is movable between a separating position where the separating member is in contact with the heating member or faces the heating member and a cleaning position separated away from the heating member farther than the separating position. The restricting piece restricts the movement of the separating member under a state where the pressing member is at the first position and permits the movement of the separating member under a state where the pressing member is at the second position.

14 Claims, 14 Drawing Sheets

FIXING DEVICE AND IMAGE FORMING APPARATUS

INCORPORATION BY REFERENCE

This application is based on and claims the benefit of priority from Japanese Patent application No. 2013-089072 filed on Apr. 22, 2013, the entire contents of which are incorporated herein by reference.

BACKGROUND

The present disclosure relates to a fixing device configured to fix a toner image on a sheet and an image forming apparatus provided with the fixing device.

An electrographic image forming apparatus, such as a copying machine and a printer, is usually provided with a fixing device configured to fix a toner image on a sheet. The fixing device includes a heating member (for example, a heating roller or a heating belt) and a pressing member (for example, a pressing roller or a pressing belt) configured to come in pressure-contact with the heating member. And, by heating and pressing the sheet and the toner image at a fixing nip formed between the heating member and the pressing member, the toner image is fixed on the sheet.

The fixing device of such a configuration is provided with a separating member which comes in contact with the heating member or faces the heating member at intervals. And, the sheet with the fixed toner image is separated from the heating member by using the separating member.

In the fixing device of such a configuration, the toner (developer)) on the sheet may be attached and then deposited on the separating member. When the toner is deposited on the separating member in this way, the deposited toner may move to the heating member and cause a damage to the heating member. Alternatively, the toner deposited on the separating member may move to the sheet and cause an image degradation.

Thus, there is a configuration that both a front surface (a surface configured to guide the sheet) and a back surface (a surface configured to face the heating member) of the separating member are coated with fluoroethylene resin to prevent attaching of the toner on the separating member. Alternatively, there is another configuration that a sheet member is attached on the separating member to prevent attaching of the toner on the separating member.

In the configuration that the both the front and back surfaces of the separating member are coated with fluoroethylene resin, when a part of the back surface of the separating member is not coated with fluoroethylene resin, the toner may attach and deposit on the part having no fluoroethylene resin coating. And, it is difficult to coat the front surface and the back surface of the separating member with a constant thickness at a time. In addition, when the coating of the front surface and the back surface of the separating member would be carried out at a time, a coating pool may be caused easily. Therefore, in order to coat the front surface and the back surface of the separating member with a consistent thickness without causing a coating pool, it is necessary to carry out the coating in several times. This leads a complication of the coating process and increase of a unit price of the separating member.

On the other hand, the configuration that the sheet member is attached on the separating member requires use of the sheet member in addition to the separating member, causing increase of the number of members and cost.

Furthermore, if the configuration that the both surfaces of the separating member are coated with fluoroethylene resin and another configuration that the sheet member is attached on the separating member may be applied, it is difficult to perfectly prevent attaching of the toner on the separating member and thereby it is required to clean the separating member. When the cleaning of the separating member may be not easily carried out, the toner deposited on the separating member may move to the heating member and cause a damage to the heating member. Alternatively, the toner deposited on the separating member may move to the sheet and cause an image degradation.

SUMMARY

In accordance with an embodiment of the present disclosure, a fixing device includes a heating source, a heating member, a pressing member, a nip pressure switching mechanism, a separating member and a restricting piece. The heating member is heated by the heating source. The pressing member comes in pressure-contact with the heating member and forms a fixing nip between the heating member and the pressing member. The nip pressure switching mechanism moves the pressing member between a first position where the fixing nip is set to have a first pressure and a second position where the fixing nip is set to have a second pressure smaller than the first pressure. The separating member is movable between a separating position where the separating member is in contact with the heating member or faces the heating member at intervals and a cleaning position separated away from the heating member farther than the separating position. The restricting piece restricts the movement of the separating member from the separating position to the cleaning position under a state where the pressing member is positioned at the first position and permits the movement of the separating member from the separating position to the cleaning position under a state where the pressing member is positioned at the second position.

In accordance with an embodiment of the present disclosure, an image forming apparatus includes a fixing device. The fixing device has a heating source, a heating member, a pressing member, a nip pressure switching mechanism, a separating member and a restricting piece. The heating member is heated by the heating source. The pressing member comes in pressure-contact with the heating member and forms a fixing nip between the heating member and the pressing member. The nip pressure switching mechanism moves the pressing member between a first position where the fixing nip is set to have a first pressure and a second position where the fixing nip is set to have a second pressure smaller than the first pressure. The separating member is movable between a separating position where the separating member is in contact with the heating member or faces the heating member at intervals and a cleaning position separated away from the heating member farther than the separating position. The restricting piece restricts the movement of the separating member from the separating position to the cleaning position under a state where the pressing member is positioned at the first position and permits the movement of the separating member from the separating position to the cleaning position under a state where the pressing member is positioned at the second position.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
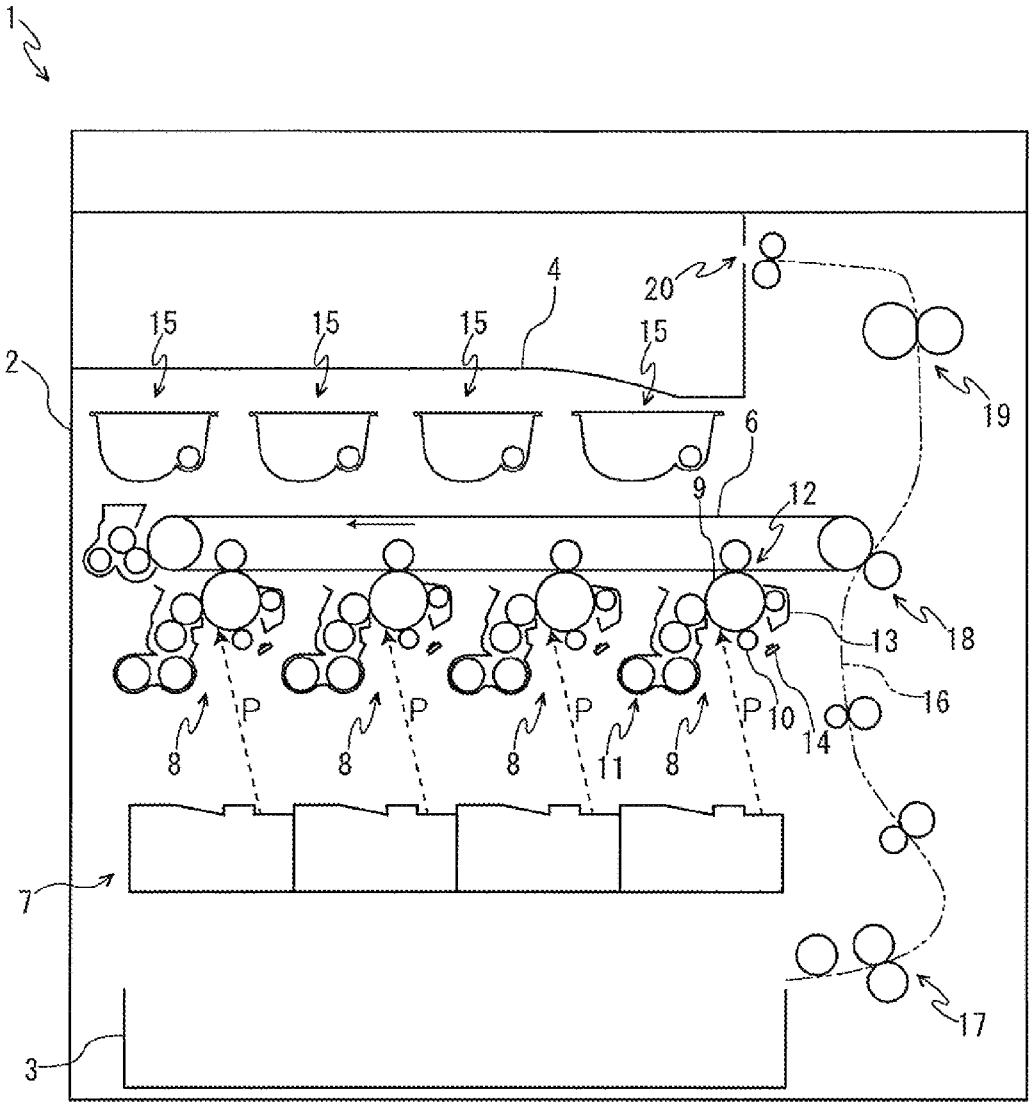
FIG. 1 is a schematic diagram schematically showing a structure of a color printer according to an embodiment of the present disclosure.

First, with reference to FIG. 1, the entire structure of a color printer 1 (an image forming apparatus) will be described. FIG. 1 is a schematic diagram schematically showing the color printer according to an embodiment of the present disclosure.

The color printer 1 includes a box-shaped printer main body 2. In a lower part of the printer main body 2, a sheet feeding cartridge 3 storing sheets (not shown) is provided and, on an upper surface of the printer main body 2, a sheet ejecting tray 4 is provided.

In a middle part of the printer main body 2, an intermediate transferring belt 6 is bridged over a plurality of rollers and, below the intermediate transferring belt 6, an exposure device 7 consisting of a laser scanning unit (LSU) is arranged. Under the intermediate transferring belt 6, four image forming units 8 are provided for respective colors (for example, four colors of magenta, cyan, yellow and black) of toners (developer). Hereinafter, one of the four image forming units 8 will be described. In each image forming unit 8, a photosensitive drum 9 is rotatably provided. Around the photosensitive drum 9, a charger 10, a development device 11, a first transferring unit 12, a cleaning device 13 and a static eliminator 14 are arranged in order of a first transferring process. Above the development device 11, four toner containers 15 corresponding to the image forming units 8 are provided for different colors (for example, four colors of magenta, cyan, yellow and black) of toners, respectively.

On one side (the right and upper side in the figure) in the printer main body 2, a sheet conveying path 16 extending in the upper and lower directions is provided. That is, the color printer 1 in the present embodiment is so-called a vertically conveying type. At an upper stream end of the conveying path 16, a sheet feeder 17 is provided. At an intermediate stream part of the conveying path 16, a second transferring unit 18 is provided at one end (the right end in the figure) of the intermediate transferring belt 6. At a lower stream part of the conveying path 16, a fixing device 19 is provided. At a lower stream end of the conveying path 16, a sheet ejecting port 20 is provided.

Next, the operation of forming an image by the color printer 1 having such a configuration will be described. When the power is supplied to the color printer 1, various parameters are initialized and initial determination, such as temperature determination of the fixing device 19, is carried out. Subsequently, when image data is inputted and a printing start is directed from a computer or the like connected with the color printer 1, the image forming operation is carried out as follows.

First, the surface of the photosensitive drum 9 is electrically charged by the charger 10. Then, the surface of the photosensitive drum 9 is irradiated with a laser (refer to an arrow P) by the exposure device 7, thereby forming an electrostatic latent image on the surface of the photosensitive drum 9. The electrostatic latent image is then developed to a toner image having a correspondent color by the developing device 11 with a toner supplied from the toner container 15. The toner image is first-transferred onto the surface of the intermediate transferring belt 6 in the first transferring unit 12. The above-mentioned operation is repeated in order by the image forming units 8, thereby forming the toner image having full color on the intermediate transferring belt 6. Toner and electric charge remained on the photosensitive drum 9 are eliminated by the cleaning device 13 and static eliminator 14.

On the other hand, a sheet fed from the sheet feeding cartridge 3 or a manual bypass tray (not shown) by the sheet feeder 17 is conveyed to the second transferring unit 18 in a suitable timing for the above-mentioned image forming operation. Then, in the second transferring unit 18, the toner image having full color on the intermediate transferring belt 6 is second-transferred onto the sheet. The sheet with the second-transferred toner image is conveyed to a lower stream side on the conveying path 16 to enter the fixing device 19, and then, the toner image is fixed on the sheet in the fixing device 19. The sheet with the fixed toner image is ejected from the first sheet ejecting port 20 on the sheet ejecting tray 4.

Figure 2:
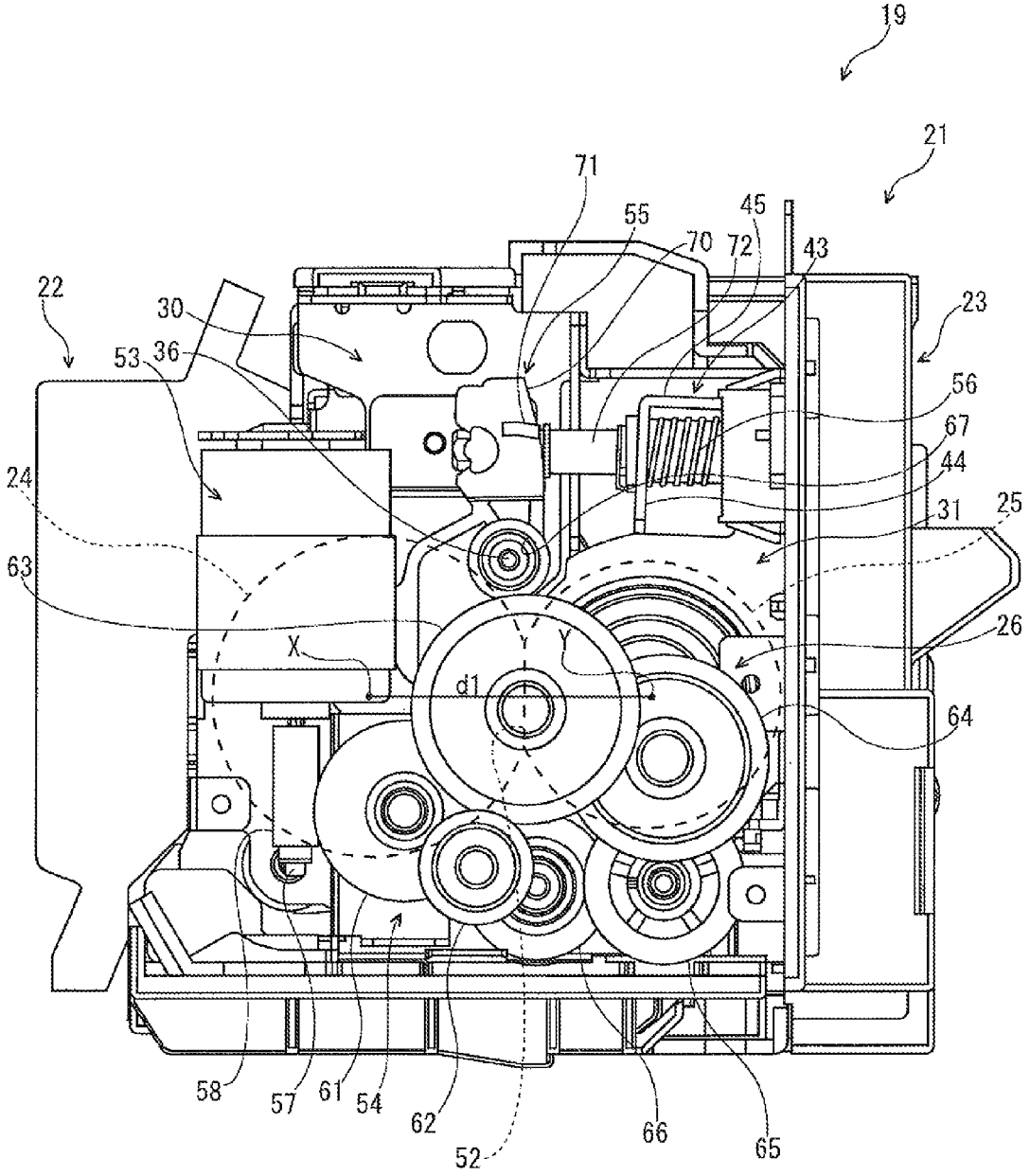
FIG. 2 is a front view showing a fixing device in a state where a pressing roller is positioned at the first position, in the color printer according to the embodiment of the present disclosure.

Next, the fixing device 19 will be described. Hereinafter, for convenient explanation, the front side viewed from the paper plane of FIG. 2 is defined as a front side of the fixing device 19. An arrow Fr suitably put on each figure indicates the front side of the fixing device 19. Since FIG. 8, FIG. 9, FIG. 11 and FIG. 14 are viewed from the back side, the left and right directions on the figures are opposite to the actual left and right directions.

As shown in FIG. 2, the fixing device 19 is provided with a fixing unit 21 and an IH (induction heating) unit 22 arranged on the left side of the fixing unit 21.

First, the fixing unit 21 of the fixing device 19 will be described. The fixing unit 21 is integrated and detachable and attachable from/to the printer main body 2.

Figure 3:
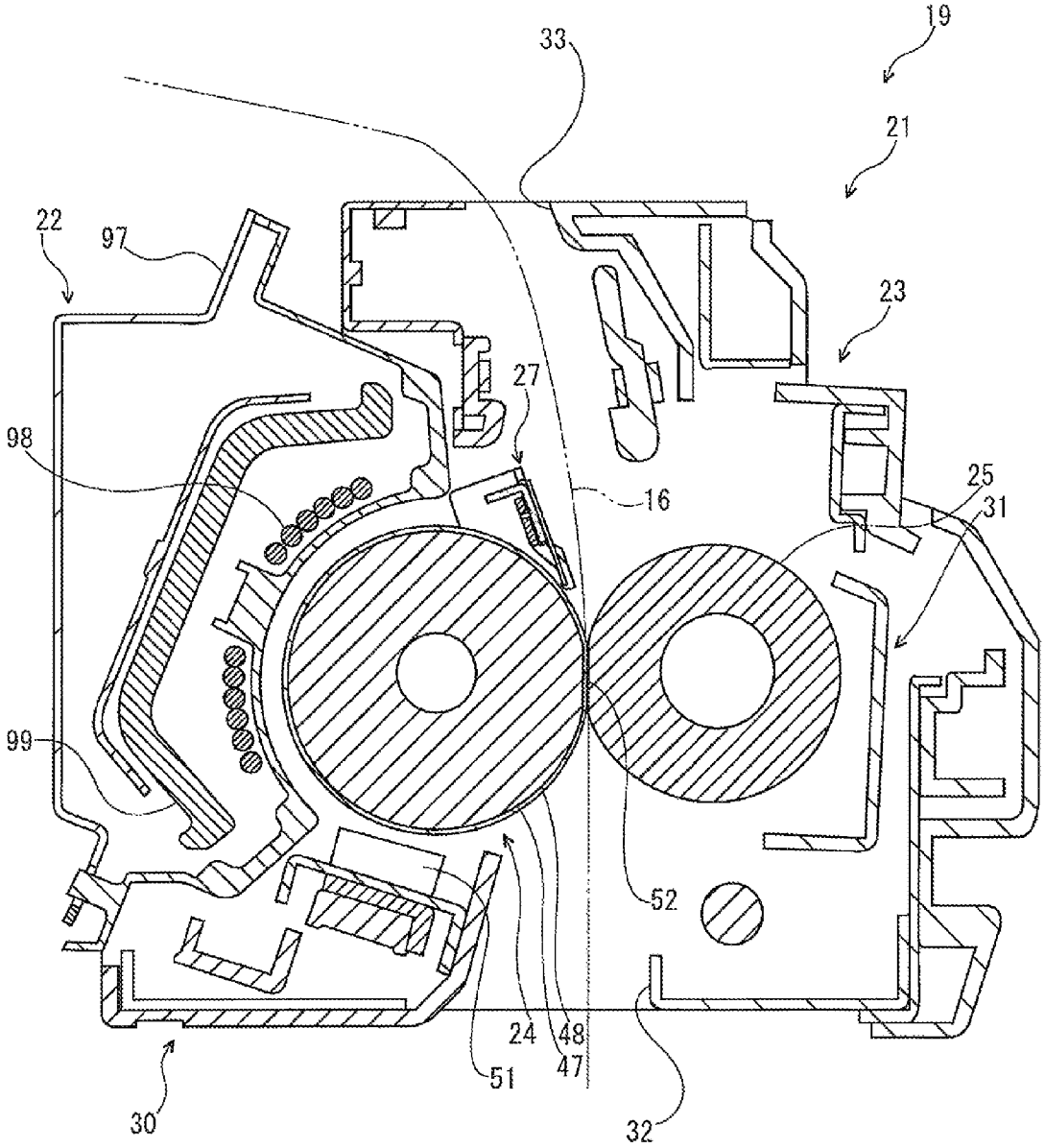
FIG. 3 is a sectional view showing the fixing device of the color printer according to the embodiment of the present disclosure.

As shown in FIG. 2 and FIG. 3, the fixing unit 21 includes a case body 23, a heating roller 24 (a heating member) stored in the left space of the case body 23, a pressing roller 25 (a pressing member) stored in the right space of the case body 23, a nip pressure switching mechanism 26 (refer to FIG. 2) arranged on each of the front and back ends of the case body 23 and a separating member 27 (refer to FIG. 3) arranged on the right and upper side of the heating roller 24.

Figure 4:
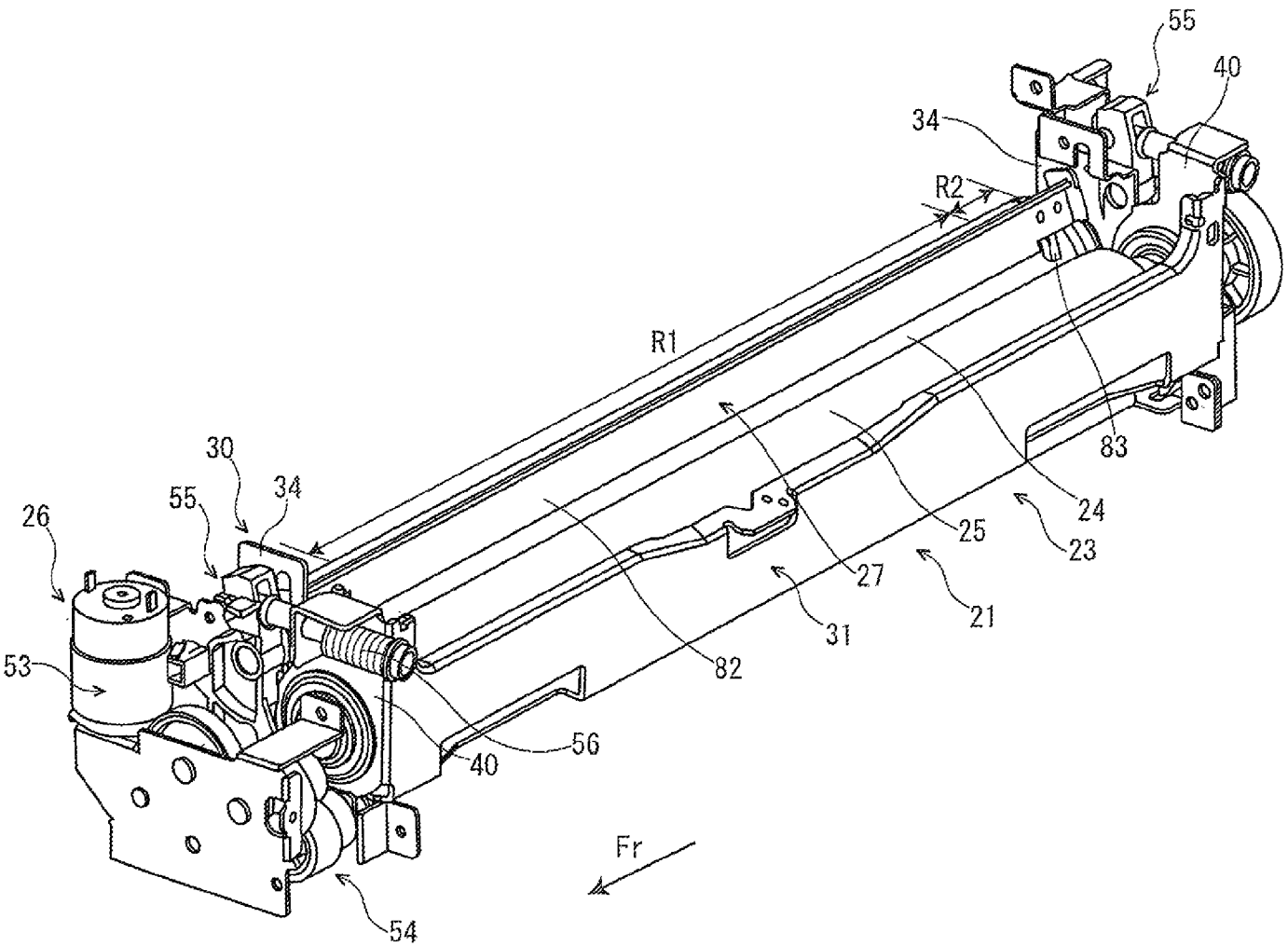
FIG. 4 is a perspective view showing the structure of the inside of a case body, in the fixing device of the color printer according to the embodiment of the present disclosure.

As shown in FIG. 4 and others, the case body 23 has a heating roller supporting part 30 (a heating member supporting part) and a pressing roller supporting part 31 (a pressing member supporting part) arranged on the right side of the heating roller supporting part 30. As shown in FIG. 3, at the lower end of the case body 23, a receiving port 32 configured to receive the sheet is formed. At the upper end of the case body 23, a discharge port 33 configured to discharge the sheet is formed.

Figure 5:
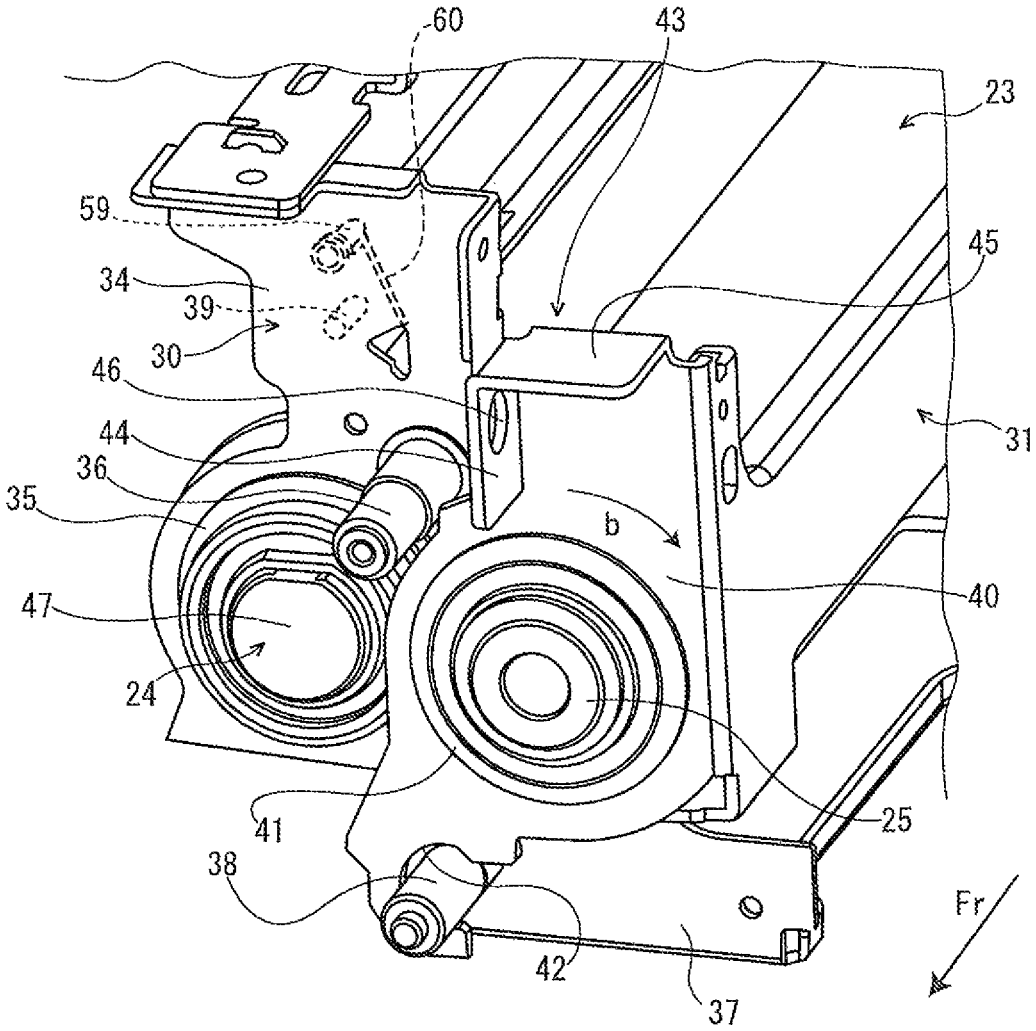
FIG. 5 is a perspective view showing the front end portion and its peripheral portion of the case body, in the fixing device of the color printer according to the embodiment of the present disclosure.

As shown in FIG. 5, at the lower portion of each of the front and back end walls 34 (FIG. 5 shows the front end wall only) of the heating roller supporting part 30, a heating roller bearing 35 is formed. On the right and upper side of the heating roller bearing 35, a first axial part 36 is protruded from the outer surface of each of the front and back end walls 34 of the heating roller supporting part 30. At the lower end portion of each of the front and back end walls 34 of the heating roller supporting part 30, an extended part 37 protruding rightward is formed. From the proximal end portion (the left end portion) of the outer surface of the extended part 37, a second axial part 38 is protruded. Above the heating roller bearing 35, a supporting pivot 39 is inwardly protruded from the inner surface of each of the front and back end walls 34 of the heating roller supporting part 30. The supporting pivot 39 is formed by a screw, for example. Above the support pivot 39, a spring holding part 59 is inwardly protruded from the inner surface of each of the front and back end walls 34 of the heating roller supporting part 30. To the spring holding part 59, a torsion coil spring 60 (a biasing member) is attached.

At the middle portion of the lower portion of each of the front and back end walls 40 (FIG. 5 shows the front end wall only) of the pressing roller supporting part 31, a pressing roller bearing 41 is formed. At the lower edge of each of the front and back end walls 40 of the pressing roller supporting part 31, an arc shaped engagement groove 42 is formed. The engagement groove 42 is engaged with the second axial part 38 formed at each of the front and back end walls 34 of the heating roller supporting part 30. Thus, the pressing roller supporting part 31 is supported by the heating roller supporting part 30 so as to turn around the second axial part 38.

At the upper end of each of the front and back end walls 40 of the pressing roller supporting part 31, a fixed piece 43 is formed. The fixed piece 43 has a side plate 44 and an upper plate 45 bent rightward from the upper edge of the side plate 44, and is formed into an approximately L-shape. The side plate 44 of the fixed piece 43 is formed with a circular penetrating hole 46 penetrating in the left and right directions.

The heating roller 24 is formed in a cylindrical shape extending in the front and back directions. As shown in FIG. 3, the heating roller 24 is stored in the heating roller supporting part 30 of the case body 23. The heating roller 24 is composed of a roller main body 47 and a belt 48 provided around the periphery of the roller main body 47.

The roller main body 47 of the heating roller 24 is formed by a cylindrical substrate layer and a cylindrical elastic layer provided around the periphery of the substrate layer, for example. The substrate layer of the roller main body 47 is made from metal such as stainless steel or aluminum, for example. The elastic layer of the roller main body 47 is formed in a cylindrical shape and is made from silicon rubber or silicon sponge, for example. FIG. 3 shows each layer (the substrate layer and the elastic layer) of the roller main body 47 without distinction between them.

As shown in FIG. 5, the front and back end portions (FIG. 5 shows the front end portion only) of the roller main body 47 of the heating roller 24 are attached to the heating roller bearings 35 formed at the front and back end walls 34 of the heating roller supporting part 30 of the case body 23. Thus, the heating roller 24 is rotatably supported by the heating roller supporting part 30.

The belt 48 (refer to FIG. 3) of the heating roller 24 is formed by a substrate layer, an elastic layer provided around the periphery of the substrate layer and a release layer coating the elastic layer, for example. The substrate layer of the belt 48 is made from metal such as nickel, for example. The elastic layer of the belt 48 is made from silicon rubber or silicon sponge, for example. The release layer of the belt 48 is made from fluoroethylene resin such as PFA (Perfluoro alkoxy alkane), for example. FIG. 3 shows each layer (the substrate layer, the elastic layer and the release layer) of the belt 48 without distinction. Hereinafter, the outer surface of the belt 48 of the heating roller 24 is described as "the outer surface of the heating roller 24".

As shown in FIG. 4 and others, on the outer surface of the heating roller 24, a sheet passing region R1 through which the sheet is passed and a non-sheet passing regions R2 arranged on the front and back sides (the outer sides) of the sheet passing region R1 and through which the sheet is not passed are formed (FIG. 4 shows the back side non-sheet passing region R2 only).

As shown in FIG. 3, under the heating roller 24, a thermistor (a temperature sensor) 51 is attached so as to detect a temperature of the heating roller 24.

The pressing roller 25 is formed in a cylindrical shape extending in the front and back directions. The pressing roller 25 is formed by a substrate layer, an elastic layer provided around the periphery of the substrate layer and a release layer coating the elastic layer. The substrate layer of the pressing roller 25 is made from metal such as stainless steel or aluminum, for example. The elastic layer of the pressing roller 25 is made from silicon rubber or silicon sponge, for example. The release layer of the pressing roller 25 is made from fluoroethylene resin such as PFA, for example. FIG. 3 shows each layer (the substrate layer, the elastic layer and the release layer) of the pressing roller 25 without distinction between them.

As shown in FIG. 5, the front and back end portions (FIG. 5 shows the front end portion only) of the pressing roller 25 are attached to the pressing roller bearings 41 formed at the front and back end walls 40 of the pressing roller supporting part 31 of the case body 23. Thus, the pressing roller 25 is rotatably supported by the pressing roller supporting part 31. As shown in FIG. 3, the pressing roller 25 comes in pressure-contact with the heating roller 24 to form a fixing nip 52 between the pressing roller 25 and the heating roller 24.

As described above, the nip pressure switching mechanism 26 is formed at each of the front and back ends of the case body 23. Firstly, the nip pressure switching mechanism 26 formed at the front end will be described.

As shown in FIG. 2 and others, the nip pressure switching mechanism 26 formed at the front end includes a driving motor 53 (a driving source), a reduction gear mechanism 54 arranged on the right side of the driving motor 53, an actuating member 55 arranged on the right and upper side of the driving motor 53 and a coil spring 56 (an elastic member) arranged on the right side of the actuating member 55.

The driving motor 53 is arranged on the front side of the heating roller supporting part 30 of the case body 23. The driving motor 53 has a motor shaft 57 extending downward. To the motor shaft 57, a warm gear 58 is fixed concentrically.

Figure 6:
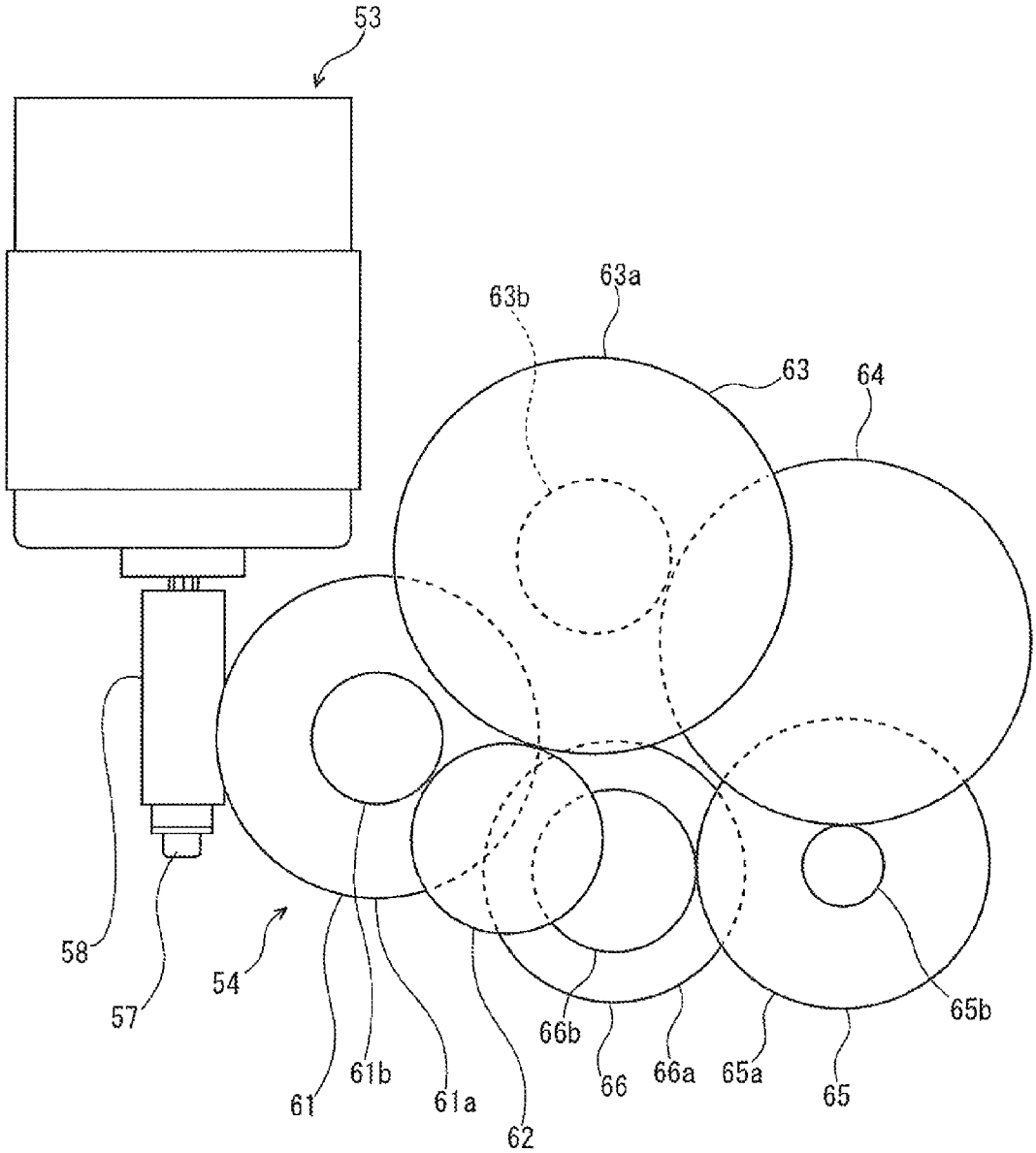
FIG. 6 is a front view showing a reduction gear mechanism, in the fixing device of the color printer according to the embodiment of the present disclosure.

As shown in FIG. 6 and others, the reduction gear mechanism 54 has a first gear 61, a second gear 62 arranged on the right and lower side of the first gear 61, a third gear 63 arranged on the right and upper side of the second gear 62, a forth gear 64 arranged on the right side of the third gear 63, a fifth gear 65 arranged on the lower side of the forth gear 64 and a sixth gear 66 arranged on the left side of the fifth gear 65.

The first gear 61 has a large-diameter part 61*a* and a small-diameter part 61*b*. The large-diameter part 61*a* of the first gear 61 is meshed with the warm gear 58 of the driving motor 53. The second gear 62 is meshed with the small-diameter part 61*b* of the first gear 61. The third gear 63 has a large-diameter part 63*a* and a small-diameter part 63*b*. The large-diameter part 63*a* of the third gear 63 is meshed with the second gear 62. The forth gear 64 is meshed with the small-diameter part 63*b* of the third gear 63. The fifth gear 65 has a large-diameter part 65*a* and a small-diameter part 65*b*. The small-diameter part 65*b* of the fifth gear 65 is meshed with the forth gear 64. The sixth gear 66 has a large-diameter part 66*a* and a small-diameter part 66*b*. The small-diameter part 66*b* of the sixth gear 66 is meshed with the large-diameter part 65*a* of the fifth gear 65.

Figure 7:
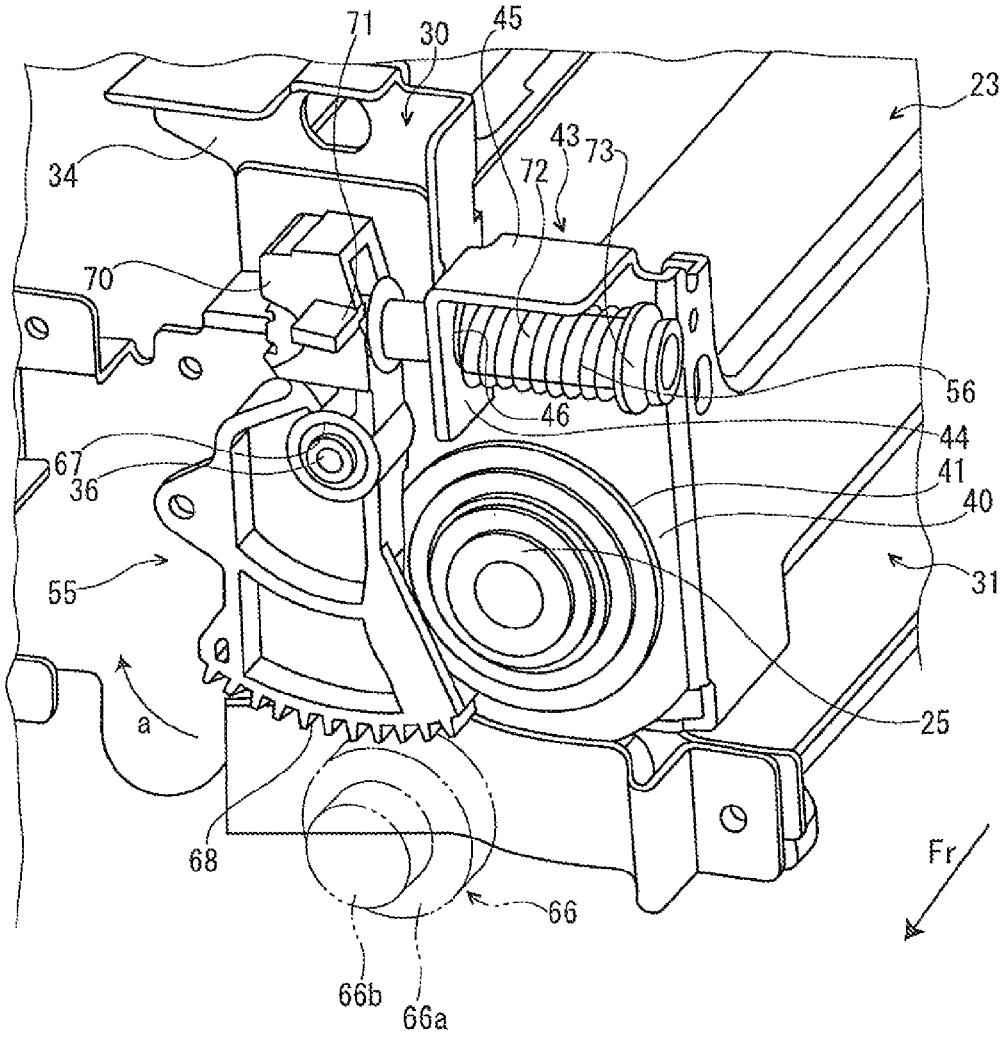
FIG. 7 is a perspective view showing an actuating member and its peripheral portion, in the fixing device of the color printer according to the embodiment of the present disclosure.

As shown FIG. 7 and others, at the upper portion of the actuating member 55, an axial hole 67 is formed. The axial hole 67 is engaged with the first axial part 36 formed at the front end wall 34 of the heating roller supporting part 30 of the case body 23. Thus, the actuating member 55 is supported by the heating roller supporting part 30 of the case body 23 so as to turn around the axial hole 67.

Under the axial hole 67, an actuating gear 68 is formed at the lower edge of the actuating member 55. The actuating gear 68 is meshed with the large-diameter part 66*a* of the sixth gear 66 of the reduction gear mechanism 54. Thus, the driving motor 53 is connected to the actuating member 55 through the reduction gear mechanism 54. In other words, the reduction gear mechanism 54 is installed between the driving motor 53 and the actuating member 55.

Above the axial hole 67, an actuating piece 70 is formed at the upper end of the actuating member 55. From the outer surface of the actuating piece 70, a detecting plate 71 is protruded. The actuating member 55 is formed with a pressing piece 72 protruding rightward from the actuating piece 70. The pressing piece 72 is formed in a straight rod-shape extending in the left and right directions. The pressing piece 72 is passed through the penetrating hole 46 of the fixed piece 43 formed at the front end wall 40 of the pressing roller supporting part 31 of the case body 23. At the distal end (the right end) of the pressing piece 72, a circular collar part 73 is formed.

Figure 8:
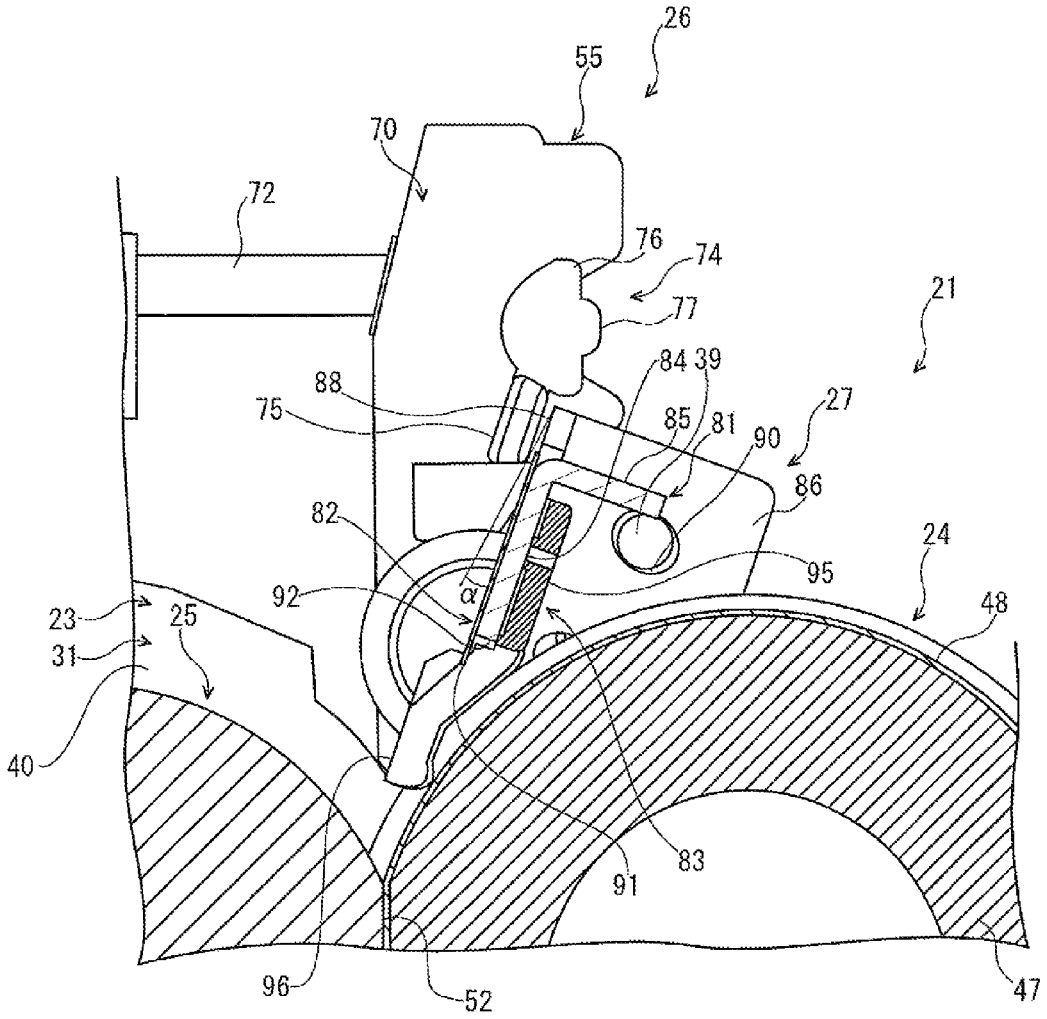
FIG. 8 is a sectional view showing a separating member and its peripheral portion in a state where the pressing roller is positioned at the first position, in the fixing device of the color printer according to the embodiment of the present disclosure.
Figure 9:
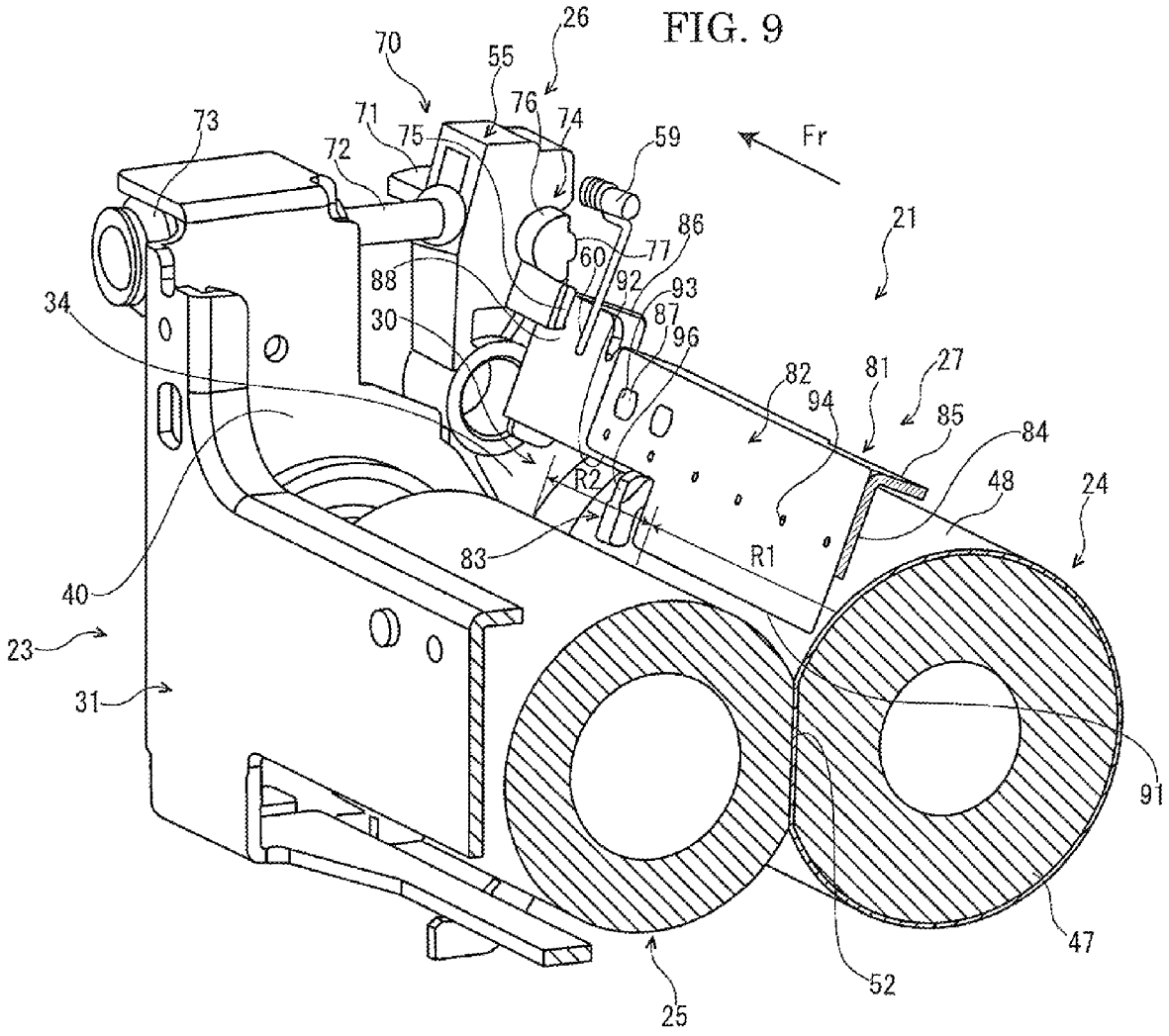
FIG. 9 is a perspective sectional view showing the separating member and its peripheral portion in a state where the pressing roller is positioned at the first position, in the fixing device of the color printer according to the embodiment of the present disclosure.

As shown in FIG. 8 and FIG. 9, from the left end portion (the right end portion in FIG. 8 and FIG. 9) of the inner surface of the actuating member 55, a restricting piece 74 is protruded. The restricting piece 74 is integrated with the actuating member 55. The restricting piece 74 has a facing part 75 protruding inward from the inner surface of the actuating member 55 and a reinforcement part 76 protruding inward from the inner surface of the actuating member 55 and coupled to the upper end of the facing part 75. The facing part 75 is formed in an approximately flat plate-shape. The right end surface (the left end surface in FIG. 8 and FIG. 9) of the reinforcement part 76 bends in an arc shape. At the left end surface (the right end surface in FIG. 8 and FIG. 9) of the reinforcement part 76, a protruded part 77 is protruded. A protruding length of the reinforcement part 76 from the inner surface of the actuating member 55 is shorter than a protruding length of the facing part 75 from the inner surface of the actuating member 55.

As shown in FIG. 7 and others, the coil spring 56 is coiled around the periphery of the pressing piece 72 of the actuating member 55. The coil spring 56 is centered in the left and right directions. The right end of the coil spring 56 is in contact with the collar part 73 of the pressing piece 72. The left end of the coil spring 56 is in contact with the side plate 44 of the fixed piece 43 formed at the pressing roller supporting part 31 of the case body 23. That is, the coil spring 56 is installed between the pressing piece 72 of the actuating member 55 and the fixed piece 43 of the pressing roller supporting part 31.

Figure 10:
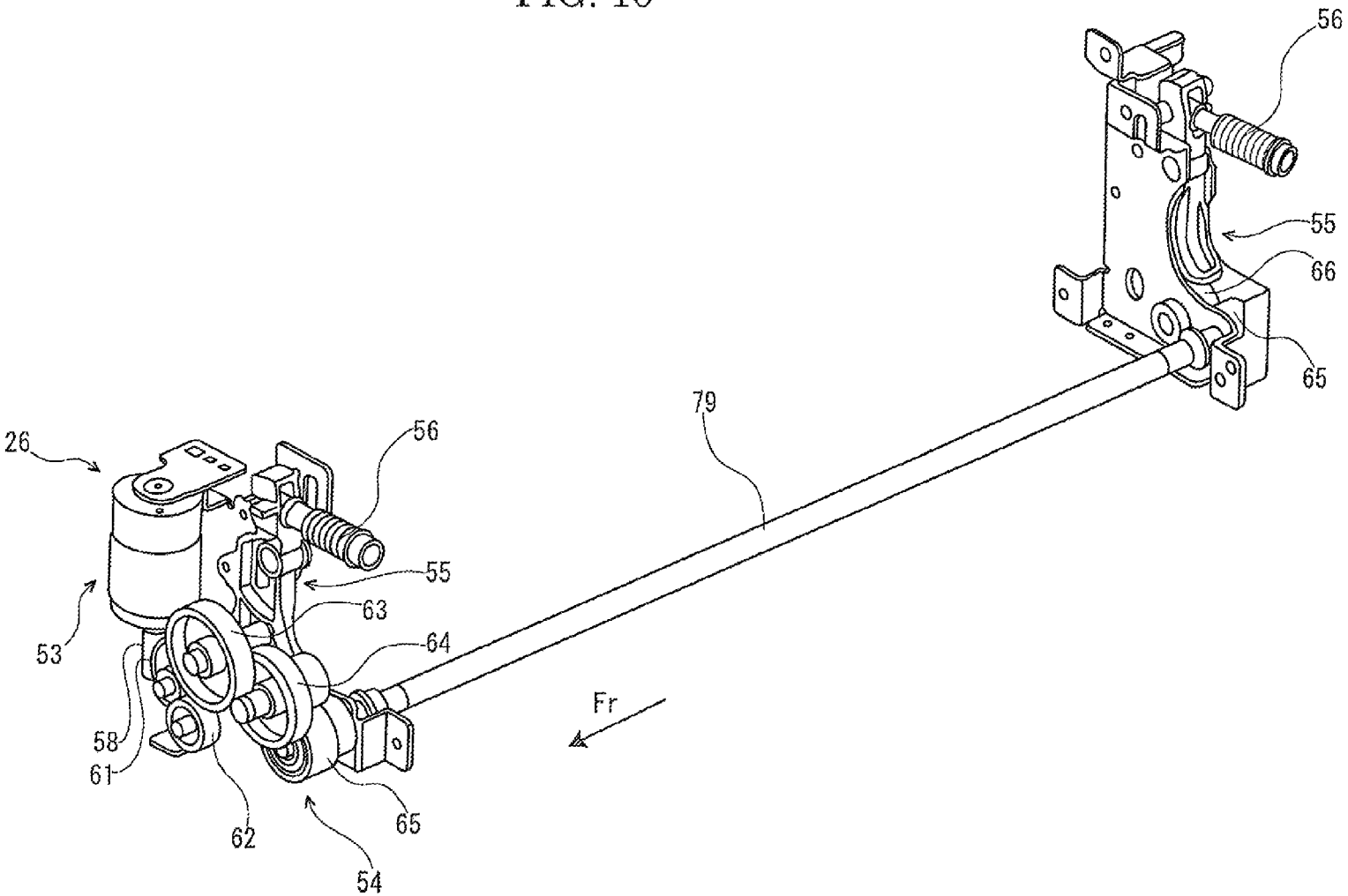
FIG. 10 is a perspective view showing a fixing nip switching mechanism, in the fixing device of the color printer according to the embodiment of the present disclosure.

As shown in FIG. 10, the nip pressure switching mechanism 26 formed on the back side does not have the driving motor 53 and the first gear 61 to the forth gear 64. The nip pressure switching mechanism 26 formed on the back side has the same configuration as the nip pressure switching mechanism 26 formed on the front side other than the above configuration. The fifth gear 65 of the nip pressure switching mechanism 26 formed on the back side is coupled to the fifth gear 65 of the nip pressure switching mechanism 26 formed on the front side through a connecting shaft 79. When the fifth gear 65 of the nip pressure switching mechanism 26 formed on the front side is rotated, the rotation is transmitted to the fifth gear 65 of the nip pressure switching mechanism 26 formed on the back side through the connecting shaft 79 and thereby the fifth gear 65 of the nip pressure switching mechanism 26 formed on the back side is rotated.

As shown in FIG. 4, the separating member 27 is formed into a long shape extending in the front and back directions. The separating member 27 is arranged on the downstream side of the heating roller 24 in the sheet conveying direction and close to the heating roller 24. As shown in FIG. 8 and FIG. 9, the separating member 27 has a supporting plate 81, a separating plate 82 supported by the supporting plate 81 and contact pieces 83 (FIG. 8 and FIG. 9 show the front side contact piece 83 only) fixed to the front and back ends of the supporting plate 81.

The supporting plate 81 of the separating member 27 is formed in a long shape extending in the front and back directions. The supporting plate 81 is made from sheet metal. The supporting plate 81 has a main body part 84, a bend part 85 bent approximately leftward (approximately rightward in FIG. 8 and FIG. 9) from the upper end of the main body part 84 and attachment parts 86 bent approximately leftward (approximately rightward in FIG. 8 and FIG. 9) from the front and back ends of the main body part 84.

As shown in FIG. 9, at the front and back portions of the main body part 84 of the supporting plate 81, a pair of front and back positioning projections 87 is formed, respectively. The bend part 85 of the supporting plate 81 has a length shorter than a length of the main body part 84 of the supporting plate 81 in the front and back directions. At the front and back ends of the main body part 84, restricted plane 88 are formed outside the bend part 85 in the front and back directions. With the restricted plane 88, the distal end of the torsion coil spring 60 comes in contact.

As shown in FIG. 8, at the upper portion of the attachment part 86 of the supporting plate 81, a long hole shaped attachment hole 90 is penetrated. Through the attachment hole 90, the supporting pivot 39 protruding from each of the front and back end walls 34 of the heating roller supporting part 30 is inserted. Thus, the separating member 27 is supported by the heating roller supporting part 30 with a turnable state around the supporting pivot 39.

As shown in FIG. 4, the separating plate 82 of the separating member 27 is formed into a long flat plate extending in the front and back directions. The outer surface of the separating plate 82 of the separating member 27 is coated with fluoroethylene resin. The outer surface of the separating plate 82 is a surface shown in the front side of the paper plane of FIG. 4 and faces the sheet on which the toner image is fixed. The inner surface of the separating plate 82 of the separating member 27 may or may not be coated with fluoroethylene resin. The inner surface of the separating plate 82 is a surface behind the paper plane of FIG. 4 and faces the heating roller 24.

As shown in FIG. 9 and others, a distal edge 91 (a lower edge) of the separating plate 82 of the separating member 27 faces the sheet passing region R1 of the heating roller 24 at predetermined intervals. At the front and lower corner and the back and lower corner of the separating plate 82, an approximately rectangle shaped notch 92 is formed, respectively. At the front and back end portions of the separating plate 82, a pair of front and back positioning holes 93 is penetrated, respectively. By inserting the positioning projections 87 formed at the supporting plate 81 into the positioning holes 93, the supporting plate 81 is positioned at the separating plate 82. At the middle portion of the separating plate 82 in the upper and lower directions, welding holes 94 configured to weld the separating plate 82 to the supporting plate 81 are formed in a row at predetermined intervals in the front and back directions.

As shown in FIG. 8 and others, the contact piece 83 of the separating member 27 has a fixed part 95 and a contact part 96 protruding downward from the lower edge of the fixed part 95. The fixed part 95 is fixed to the main body part 84 of the supporting plate 81. As shown in FIG. 9 and others, the lower end surface of the contact part 96 comes in contact with the non-sheet passing region R2 of the heating roller 24. The separating member 27 is biased toward the heating roller 24 by the torsion coil spring 60 which comes in contact with the restricted plane 88. Therefore, the contact state of the lower end surface of the contact part 96 with the non-sheet passing region R2 of the heating roller 24 is kept and thereby an interval between the distal edge 91 of the separating plate 82 and the sheet passing region R1 is kept constant.

Figure 11:
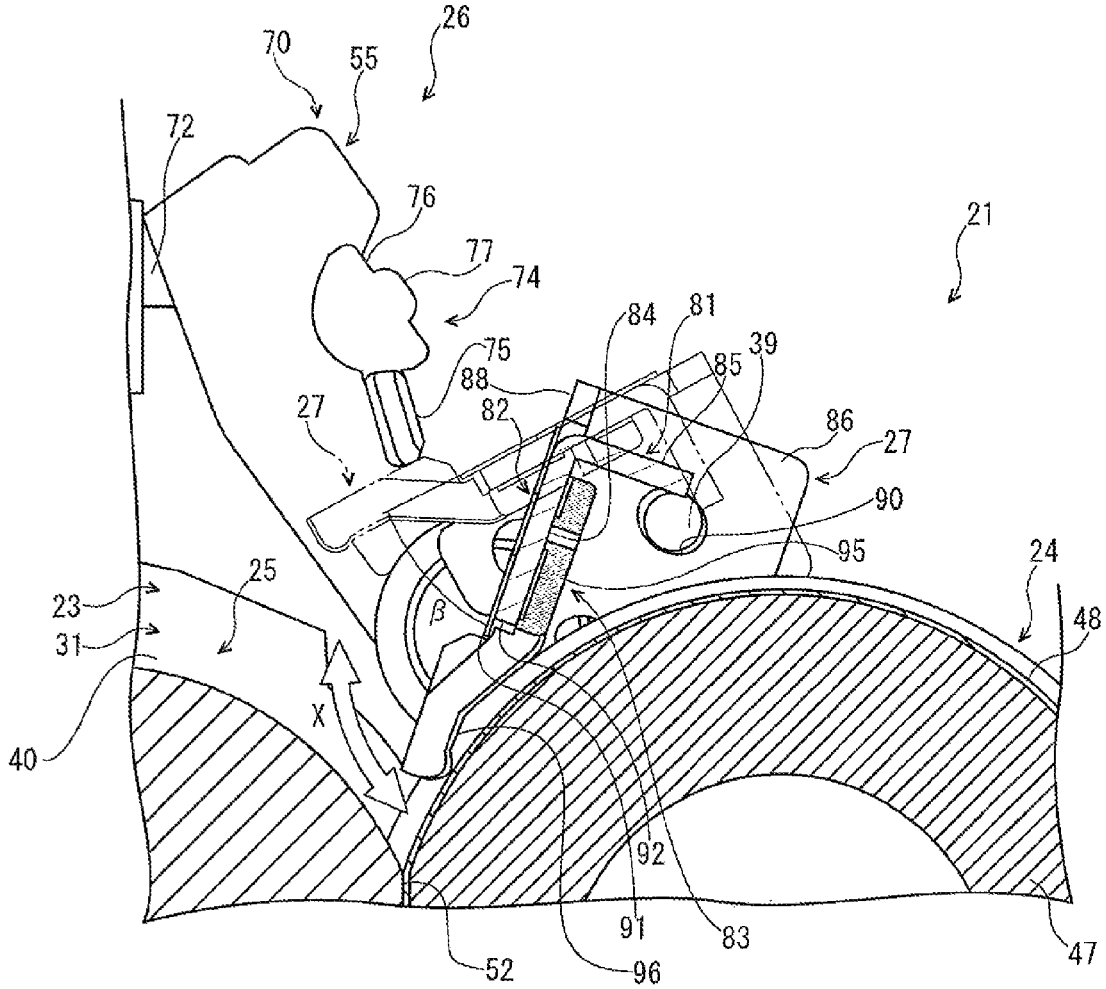
FIG. 11 is a sectional view showing the separating member and its peripheral portion in a state where the pressing roller is positioned at the second position, in the fixing device of the color printer according to the embodiment of the present disclosure.

Hereinafter, a position of the separating member 27 in a state where the distal edge 91 of the separating plate 82 of the separating member 27 faces the outer surface of the heating roller 24 at predetermined intervals is called as "a separating position" of the separating member 27 (refer to the solid line in FIG. 11). On the other hand, a position where the distal edge 91 of the separating plate 82 of the separating member 27 is spaced away from the outer surface of the heating roller 24 farther than the separating position is called as "a cleaning position" of the separating member 27 (refer to the two-dot chain line in FIG. 11). The separating member 27 is provided so as to turn around the supporting pivot 39 between the separating position and the cleaning position (refer to an arrow X in FIG. 11).

Next, the IH unit 22 of the fixing device 19 will be described. The IH unit 22 is fixed to the printer main body 2. As shown in FIG. 3, the IH unit 22 includes a case member 97, an IH coil 98 (a heating source) stored in the case member 97 and formed in an arc shape around the periphery of the heating roller 24 and an arcuate core 99 stored in the case member 97 and formed around the periphery of the IH coil 98.

A control system of the fixing device 19 will be described.

Figure 12:
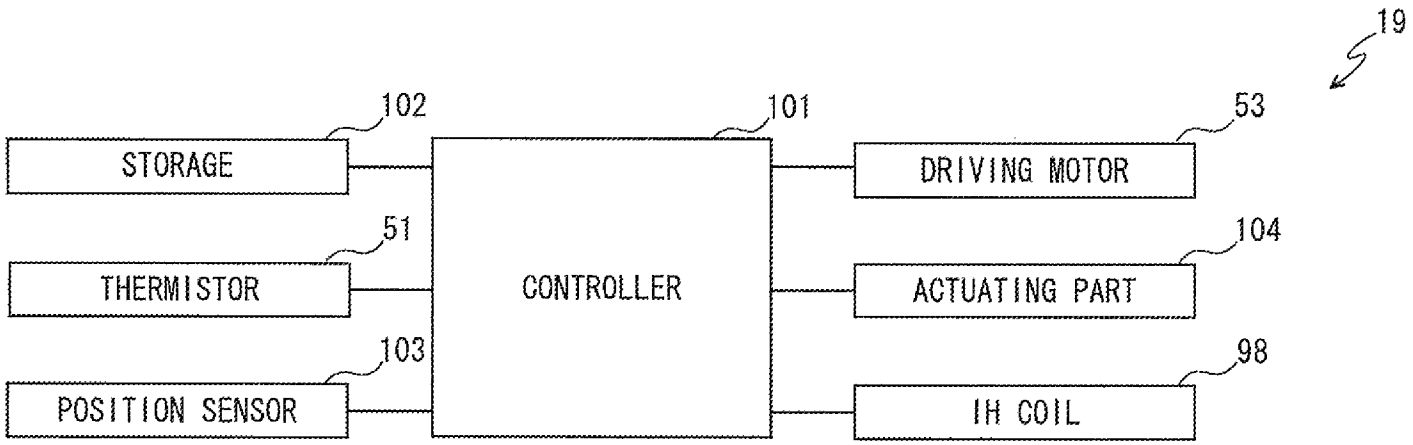
FIG. 12 is a schematic block diagram showing the fixing device of the color printer according to the embodiment of the present disclosure.

As shown in FIG. 12, the fixing device 19 is provided with a controller (a CPU (Central processing unit)) 101. The controller 101 is connected to a storage 102 composed of a memory such as ROM (Read only memory), RAM (Random access memory) and the like and is configured to control each part of the fixing device 19 according to a control program and control data stored in the storage 102.

The controller 101 is connected to the thermistor 51 so that a temperature of the heating roller 24 detected by the thermistor 51 is output to the controller 101.

The controller 101 is connected to a position sensor 103. The position sensor 103 detects a position of the detecting plate 71 (refer to FIG. 7 and others) protruding from the outer surface of the actuating piece 70 of the actuating member 55.

The controller 101 is connected to the driving motor 53. When the warm gear 58 of the driving motor 53 is rotated according to the drive command signal from the controller 101, the rotation is transmitted to the actuating member 55 through the reduction gear mechanism 54 and thereby the actuating member 55 is turned. That is, the actuating member 55 is turned by the driving force applied from the driving motor 53.

The controller 101 is connected to an actuating part 104 composed of a motor and the like and the actuating part 104 is connected to the pressing roller 25. When the actuating part 104 rotates the pressing roller 25 according to the drive command signal from the controller 101, the heating roller 24 which comes in pressure-contact with the pressing roller 25 is rotated in the direction opposite to the rotation direction of the pressing roller 25.

The controller 101 is connected to the IH coil 98. When a high frequency current flows the IH coil 98 according to the drive command signal from the controller 101, the IH coil 98 generates a high frequency magnetic field which heats the heating roller 24.

In the fixing device 18 having the above-mentioned configuration, when the toner image is fixed to the sheet such as a plane paper, as shown in FIG. 2, a distance (hereinafter, called as "an inter-axis distance") between a rotation axis X of the heating roller 24 and a rotation axis Y of the pressing roller 25 is set to a distance d1. A pressure of the fixing nip 52 (hereinafter, called as "a nip pressure") at the time is set to a first pressure P1 and a position of the pressing roller 25 is set to a first position.

In a state where the pressing roller 25 is positioned at the first position, as shown in FIG. 8 and FIG. 9, the facing part 75 of the restricting piece 74 faces the restricted plane 88 of the supporting plate 81 of the separating member 27 with a little interval. Therefore, as shown in FIG. 8, a turnable angle (a movable range) of the separating member 27 is limited to an angle α and the turning of the separating member 27 from the separating position to the cleaning position is restricted.

Under this state, when the sheet such as a plane paper is conveyed from the upstream side (the lower side) along the conveying path 16, the sheet passes through the fixing nip 52. Thus, the sheet and the toner image are heated and pressed each other to fix the toner image on the sheet. The sheet on which the toner image is fixed is separated from the outer surface of the heating roller 24 by the separating plate 82 of the separating member 27. Therefore, the first pressure P1 is a pressure to pass the plane paper, that is, a pressure to fix the toner image on the plane paper at the fixing nip 52.

When the sheet such as a plane paper is separated from the outer surface of the heating roller 24 by the separating plate 82 of the separating member 27, the leading edge of the sheet comes in contact with the separating plate 82 of the separating member 27 and a force (hereinafter, called as "a push-up force of the sheet") for pushing the separating member 27 upward by the sheet is produced. However, the separating member 27 is biased toward the heating roller 24 by the torsion coil spring 60 with substantially the same force as the push-up force of the sheet. Therefore, unless the push-up force of the sheet becomes larger than the biasing force of the torsion coil spring 60, the contact state of the lower end surface of the contact part 96 with the non-sheet passing region R2 of the heating roller 24 is kept and thereby an interval between the distal edge 91 of the separating plate 82 and the sheet passing region R1 of the heating roller 24 is kept constant. If the push-up force of the sheet would become larger than the biasing force of the torsion coil spring 60, since the restricted plane 88 of the supporting plate 81 of the separating member 27 comes in contact with the facing part 75 of the restricting piece 74, the turning of the separating member 27 is restricted.

Figure 13:
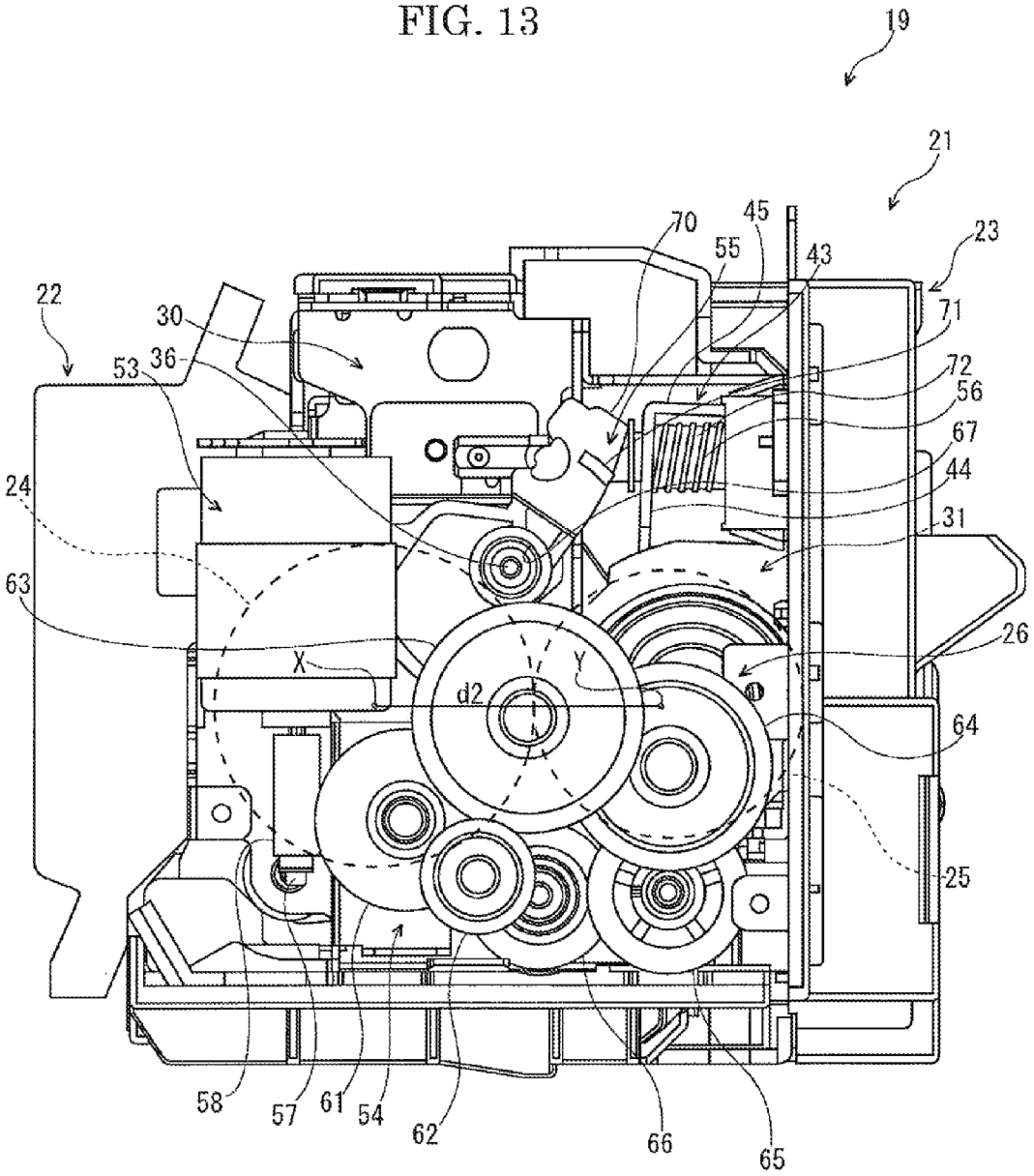
FIG. 13 is a front view showing the fixing device in a state where the pressing roller is positioned at the second position, in the color printer according to the embodiment of the present disclosure.

On the other hand, when the toner image is fixed to a sheet such as a cardboard or an operator, such as a service man and a user, cleans the separating member 27, according to the drive command signal from the controller 101, the warm gear 58 of the driving motor 53 is rotated in the predetermined direction. The rotation is transmitted to the actuating gear 68 (refer to FIG. 7) of the actuating member 55 through the reduction gear mechanism 54 and thereby the actuating member 55 is turned in one direction (the clockwise direction in the front view, refer to an arrow a in FIG. 7). With the turning, the pressing piece 72 of the actuating member 55 is moved in the right direction and the pressing roller supporting part 31 is turned around the second axial part 38 (refer to FIG. 5) in the direction (the clockwise direction in the front view, refer to an arrow b in FIG. 5) separated away from the heating roller supporting part 30. With the turning, as shown in FIG. 13, the pressing roller 25 is moved in the direction separated away from the heating roller 24 and the nip pressure decreases to a second pressure P2 lower than the first pressure P1. The position of the pressing roller 25 at this time is set to a second position. As mentioned above, the nip pressure switching mechanism 26 is configured to move the pressing roller 25 between the first position and the second position.

When the actuating member 55 is turned in the one direction as mentioned above, as shown in FIG. 14, the restricting piece 74 integrated with the actuating member 55 is moved in the right direction (the left direction in FIG. 14). When the restricting piece 74 is moved in the right direction, the facing part 75 of the restricting piece 74 is moved in the direction separated away from the restricted plane 88 of the supporting plate 81 of the separating member 27. With this movement, as shown in FIG. 11, the turnable angle (the movable range) of the separating member 27 increases to an angle β larger than the angle α and thereby the turning of the separating member 27 from the separating position (refer to the solid line in FIG. 11) to the cleaning position (refer to the two-dot chain line in FIG. 11) is permitted. Therefore, the operator can turn the separating member 27 from the separating position to the cleaning position and then remove the toner deposited on the separating plate 82 of the separating member 27. Especially, by turning the separating member 27 from the separating position to the cleaning position as mentioned above, it becomes possible to easily remove the toner deposited on the inner surface (the surface facing the heating roller 24 of the separating plate 82 of the separating member 27).

As mentioned above, although the torsion coil spring 60 biases the separating member 27 toward the heating roller 24, the biasing force is not so large. Therefore, when the separating member 27 is cleaned in the above mentioned way, the operator can easily turn the separating member 27 from the separating position to the cleaning position.

Figure 14:
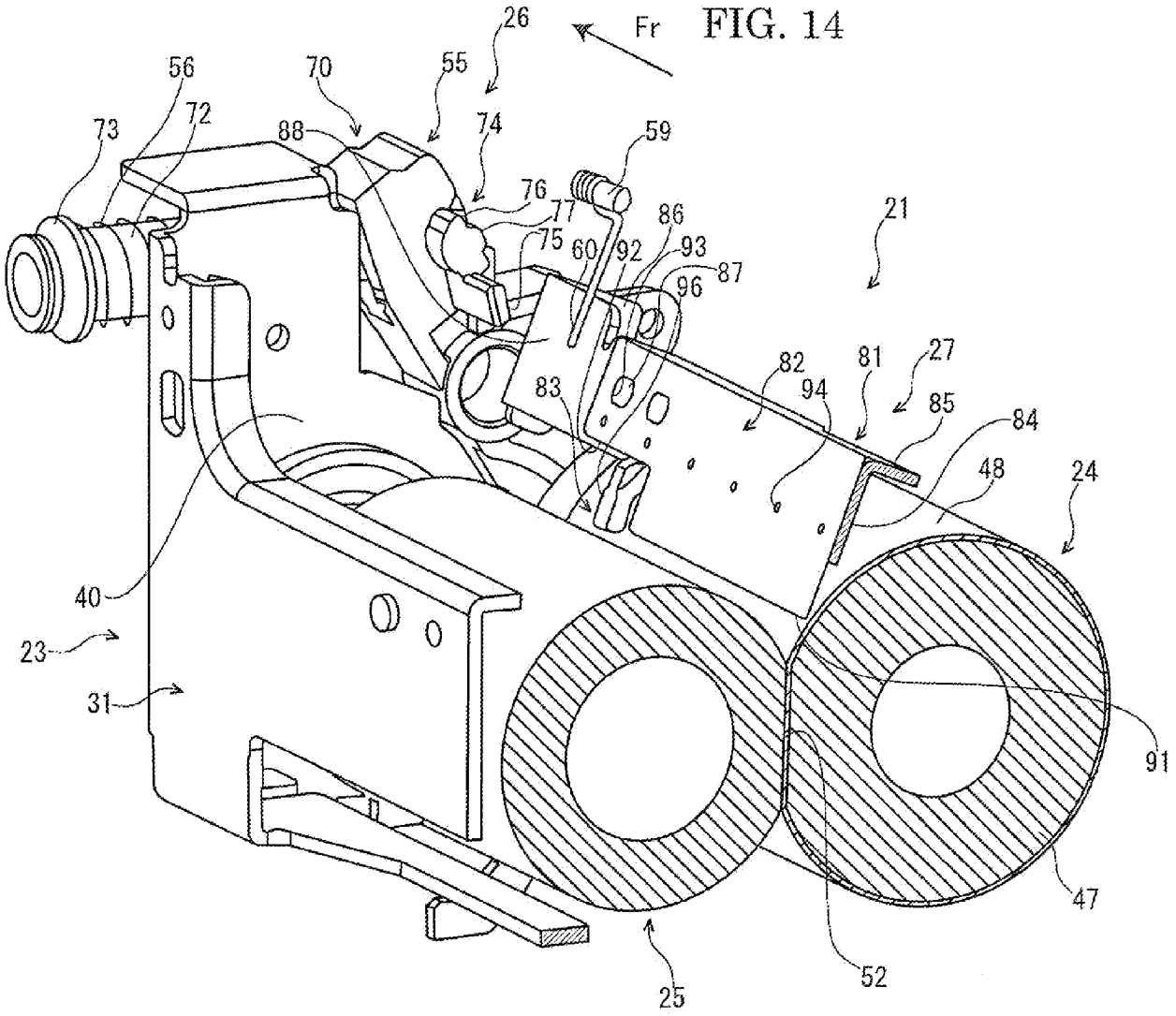
FIG. 14 is a perspective sectional view showing the separating member and its peripheral portion in a state where the pressing roller is positioned at the second position, in the fixing device of the color printer according to the embodiment of the present disclosure.

When the toner image is fixed on the sheet such as a cardboard, similarly to a case in which the toner image is fixed on the sheet such as a plane paper, the sheet such as a cardboard is separated from the outer surface of the heating roller 24 by the separating plate 82 of the separating member 27. As shown in FIG. 14, since the separating member 27 is biased toward the heating roller 24 by the torsion coil spring 60, there is low possibility that the separating member 27 is pushed upward by the sheet such as a cardboard. Accordingly, the second pressure P2 is a pressure to pass the cardboard, that is, a pressure to fix the toner image to the cardboard at the fixing nip 52.

The sheet such as a cardboard has a rigidity higher than a sheet such as a plane paper. Accordingly, the sheet such as a cardboard may be separated from the heating roller 24 by oneself owing to so-called self-stripping property without contact with the separating plate 82 of the separating member 27.

In the present embodiment, as mentioned above, under a state where the pressing roller 25 is positioned at the first position, the restricting piece 74 restrict the turning of the separating member 27 from the separating position to the cleaning position. Therefore, the separating member 27 can be kept at the separating position and thereby the separating plate 82 of the separating member 27 can surely separate the sheet from the outer surface of the heating roller 24. And, the separating member 27 is prevented from being pushed upward from the separating position to the cleaning position by the sheet passed through the fixing nip 52. Therefore, a defect, such as a paper jamming caused by entering of the sheet between the separating member 27 and the heating roller 24, can be avoided.

On the other hand, under a state where the pressing roller 25 is positioned at the second position, the restricting piece 74 permits the tuning of the separating member 27 from the separating position to the cleaning position. Therefore, it becomes possible to turn the separating member 27 from the separating position to the cleaning position and then to clean the separating member 27 easily. Accordingly, it is prevented to move the toner deposited on the separating member 27 to the heating roller 24 and to cause a damage on the heating roller 24. And, it is also prevented to move the toner deposited on the separating member 27 to the sheet and to cause image degradation.

The pressing roller 25 is configured so as to move between the first position and the second position with the turning of the pressing roller supporting part 31 relative to the heating roller supporting part 30. By applying such a configuration, it becomes possible to move the pressing roller 25 between the first position and the second position smoothly.

The restricting piece 74 is configured so as to be integrated with the actuating member 55. By applying such a configuration, it becomes possible to reduce the number of the parts and thus to reduce the manufacturing cost of the fixing device 19 compared with a case in which the restricting piece 74 and the actuating member 55 are made independently.

The actuating member 55 is configured such that a protruding length of the reinforcement part 76 of the restricting piece 74 from the inner surface of the actuating member 55 is shorter than a protruding length of the facing part 75 of the restricting piece 74 from the inner surface of the restricting piece 74. By applying such a configuration, it becomes possible to sufficiently reinforce the facing part 75 by the reinforcement part 76 and thus to prevent the facing part 75 from being damaged by an impact occurred when the separating member 27 comes in contact with the facing part 75 and the like.

The separating member 27 is configured so as to have the separating plate 82 facing the sheet passing region R1 of the heating roller 24 at predetermined intervals, the supporting plate 81 supporting the separating plate 82 and the contact piece 83 fixed to the supporting plate 81 and coming in contact with the non-sheet passing region R2 of the heating roller 24. By applying such a configuration, it becomes possible to keep the interval between the sheet passing region R1 of the heating roller 24 and the separating plate 82 constant without damaging the sheet passing region R1 of the heating roller 24.

The separating member 27 is configured so as to be turnable between the separating position and the cleaning position. By applying such a configuration, the back surface (the surface facing the heating roller 24) of the separating plate 82 of the separating member 27 can be easily cleaned.

The second pressure P2 is a pressure to pass a cardboard, that is, a pressure to fix the toner image to the cardboard at the fixing nip 52. Therefore, when the fixing nip 52 is kept at the second pressure P2, the sheet can be separated from the outer surface of the heating roller 24 owing to the self-stripping property without contacting the sheet to the separating plate 82 of the separating member 27. Accordingly, it becomes possible to prevent the separating member 27 from being pushed upward by the sheet.

In the present embodiment, while the restricting piece 74 is integrated with the actuating member 55, in another embodiment, the restricting piece 74 and the actuating member 55 may be made independently. In this case, the restricting piece 74 may be connected to the actuating member 55 through a link mechanism, for example.

In the present embodiment, while the separating member 27 is biased toward the heating roller 24 by the torsion coil spring 60, in another embodiment, a coil spring, a plate spring, a wire spring or the like may be used to bias the separating member 27 toward the heating roller 24. And, in still another embodiment, a biasing member configured to bias the separating member 27 toward the heating roller 24 may not be provided.

In the present embodiment, while the separating member 27 turns between the separating position and the cleaning position, in another embodiment, the separating member 27 may slide straightly between the separating position and the cleaning position.

In the present embodiment, the nip pressure is changed dependent on the type of the sheet. In another embodiment, the nip pressure may be changed dependent on an image forming period or a non-image forming period (for example, a paper jamming maintenance period).

In the present embodiment, while the nip pressure is switched into two stages of the pressure P1 and the pressure P2, in another embodiment, the nip pressure may be switched into three or more stages.

In the present embodiment, when the pressing roller 25 is positioned at the second position, the pressing roller 25 comes in pressure-contact with the heating roller 24. However, in another embodiment, when the pressing roller 25 is positioned at the second position, the pressing roller 25 may be separated away from the heating roller 24. That is, the second pressure P2 may be zero.

In the present embodiment, while the actuating part 104 is connected to the pressing roller 25, in another embodiment, the actuating part 104 may be connected to the heating roller 24.

In the present embodiment, while the IH coil 98 is used as a heating source, in another embodiment, a heater, such as a halogen heater or a ceramic heater, may be used as the heating source.

In the present embodiment, while the heating roller 24 composed of the roller main body 47 and the belt 48 is used as the heating member, in another embodiment, the roller main body 47 or the belt 48 may be used as the heating member independently.

In the embodiment, while the configuration of the disclosure is applied to the color printer 1, in another embodiment, the configuration of the disclosure may be applied to a monochrome printer, a copying machine, a facsimile, a multifunction peripheral or the like.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a heating source;

a heating member configured to be heated by the heating source;

a pressing member configured to come in pressure-contact with the heating member and to form a fixing nip between the heating member and the pressing member;

a nip pressure switching mechanism configured to move the pressing member between a first position where the fixing nip is set to have a first pressure and a second position where the fixing nip is set to have a second pressure smaller than the first pressure;

a separating member configured to be movable between a separating position where the separating member is in contact with the heating member or faces the heating member at intervals and a cleaning position separated away from the heating member farther than the separating position;

a restricting piece configured to restrict the movement of the separating member from the separating position to the cleaning position under a state where the pressing member is positioned at the first position and to permit the movement of the separating member from the separating position to the cleaning position under a state where the pressing member is positioned at the second position; and a case body including a heating member supporting part configured to rotatably support the heating member and a pressing member supporting part configured to rotatably support the pressing member and to be turnably supported by the heating member supporting part, wherein the pressing member is configured to be moved between the first position and the second position with a turning of the pressing member supporting part relative to the heating member supporting part, wherein the nip pressure switching mechanism includes a driving source;

an actuating member configured to be turned by a driving power from the driving source; and an elastic member arranged between the actuating member and the pressing member supporting part, wherein the restricting piece is integrated with the actuating member, wherein the restricting piece includes a facing part protruding from an inner surface of the actuating member and facing the separating member; and a reinforcement part protruding from the inner surface of the actuating member and coupled to the facing part;

wherein a protruding length of the reinforcement part from the inner surface of the actuating member is shorter than a protruding length of the facing part from the inner surface of the actuating member.

2. The fixing device according to claim 1, wherein the heating member includes a sheet passing region through which a sheet is passed; and a non-sheet passing region configured to be arranged outside the sheet passing region, and the separating member includes a separating plate configured to face the sheet passing region at intervals;

a supporting plate configured to support the separating plate; and a contact piece configured to be fixed to the supporting plate and to come in contact with the non-sheet passing region.

3. The fixing device according to claim 2, wherein the restricting piece faces the supporting plate so as to restrict the movement of the separating member from the separating position to the cleaning position under the state where the pressing member is positioned at the first position.

4. The fixing device according to claim 2, further comprising a biasing member configured to come in contact with the supporting plate and to bias the separating member toward the heating member side.

5. The fixing device according to claim 1, wherein the separating member is configured to be turnable between the separating position and the cleaning position.

6. The fixing device according to claim 1, wherein the second pressure is a pressure to pass a cardboard.

7. The fixing device according to claim 1, wherein the first pressure is a pressure to pass a plane paper.

8. An image forming apparatus comprising a fixing device, wherein the fixing device includes:

a heating source;

a heating member configured to be heated by the heating source;

a pressing member configured to come in pressure-contact with the heating member and to form a fixing nip between the heating member and the pressing member;

a nip pressure switching mechanism configured to move the pressing member between a first position where the fixing nip is set to have a first pressure and a second position where the fixing nip is set to have a second pressure smaller than the first pressure;

a separating member configured to be movable between a separating position where the separating member is in contact with the heating member or faces the heating member at intervals and a cleaning position separated away from the heating member farther than the separating position;

a restricting piece configured to restrict the movement of the separating member from the separating position to the cleaning position under a state where the pressing member is positioned at the first position and to permit the movement of the separating member from the separating position to the cleaning position under a state where the pressing member is positioned at the second position; and a case body having a heating member supporting part configured to rotatably support the heating member and a pressing member supporting part configured to rotatably support the pressing member and to be turnably supported by the heating member supporting part, wherein the pressing member is configured to be moved between the first position and the second position with a turning of the pressing member supporting part relative to the heating member supporting part, wherein the nip pressure switching mechanism has a driving source;

an actuating member configured to be turned by a driving power from the driving source; and an elastic member arranged between the actuating member and the pressing member supporting part, wherein the restricting piece is integrated with the actuating member, wherein the restricting piece has a facing part protruding from an inner surface of the actuating member and facing the separating member; and a reinforcement part protruding from the inner surface of the actuating member and coupled to the facing part;

wherein a protruding length of the reinforcement part from the inner surface of the actuating member is shorter than a protruding length of the facing part from the inner surface of the actuating member.

9. The image forming apparatus according to claim 8, wherein the heating member has a sheet passing region through which a sheet is passed; and a non-sheet passing region configured to be arranged outside the sheet passing region, and the separating member includes a separating plate configured to face the sheet passing region at intervals;

a supporting plate configured to support the separating plate; and a contact piece configured to be fixed to the supporting plate and to come in contact with the non-sheet passing region.

10. The image forming apparatus according to claim 9, wherein the restricting piece faces the supporting plate so as to restrict the movement of the separating member from the separating position to the cleaning position under a state where the pressing member is positioned at the first position.

11. The image forming apparatus according to claim 9, wherein the fixing device further includes a biasing member configured to come in contact with the supporting plate and to bias the separating member toward the heating member side.

12. The image forming apparatus according to claim 8, wherein the separating member is configured to be turnable between the separating position and the cleaning position.

13. The image forming apparatus according to claim 8, wherein the second pressure is a pressure to pass a cardboard.

14. The image forming apparatus according to claim 8, wherein the first pressure is a pressure to pass a plane paper.

* * * * *